United States Patent [19]

Holk, Jr. et al.

[11] 4,182,460

[45] Jan. 8, 1980

[54] LEVER ACTION TAB SYSTEM FOR EASY OPENING ENDS

[75] Inventors: Albert J. Holk, Jr., Frankfort; Arnold R. Boik, Chicago, both of Ill.

[73] Assignee: Continental Can Company, Inc., New York, N.Y.

[21] Appl. No.: 656,388

[22] Filed: Jul. 27, 1967

[51] Int. Cl.[2] ..... B65D 41/32

[52] U.S. Cl. ..... 220/271; 220/273

[58] Field of Search ..... 220/48, 54, 27, 44, 220/266-273; 215/46; 222/541

[56] References Cited

U.S. PATENT DOCUMENTS

| | | | |
|---|---|---|---|
| 3,215,305 | 11/1965 | Frankenberg | 220/48 |
| 3,273,744 | 9/1966 | Fraze | 220/54 |
| 3,283,946 | 11/1966 | Stec | 220/54 |
| 3,366,270 | 1/1968 | Khoury | 220/54 |

*Primary Examiner*—George T. Hall

*Attorney, Agent, or Firm*—Charles E. Brown

[57] ABSTRACT

This disclosure has to do with an easy opening container end wherein substantially the entire end panel is removed. The removable panel portion has rigidly attached thereto a pull tab which is first utilized as a lever to obtain the initial rupture of the end panel and then as a handle to tear out the removable panel portion. The removable panel portion is provided with a weakening line immediately adjacent the connection between the pull tab and the removable panel portion for the purpose of first venting the interior of a container and then forming a hinge which will permit the necessary pivoting of the pull tab relative to the end panel.

54 Claims, 6 Drawing Figures

FIG.1
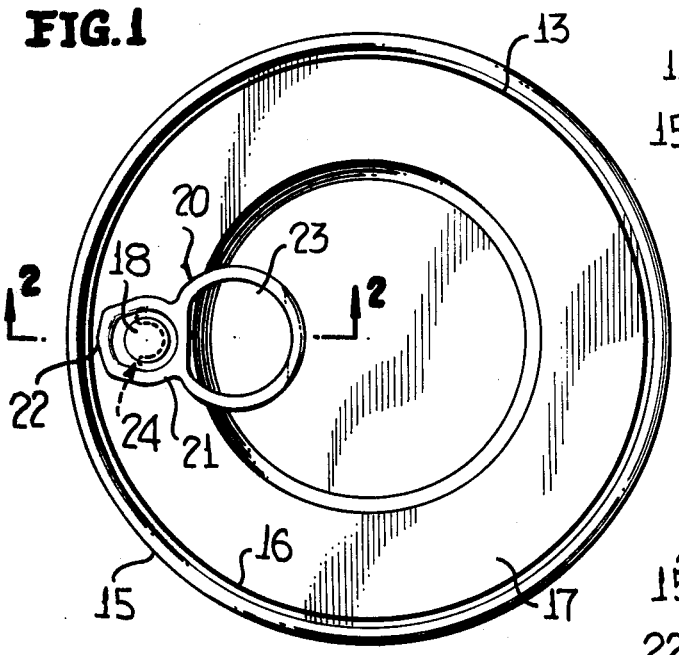
FIG.3
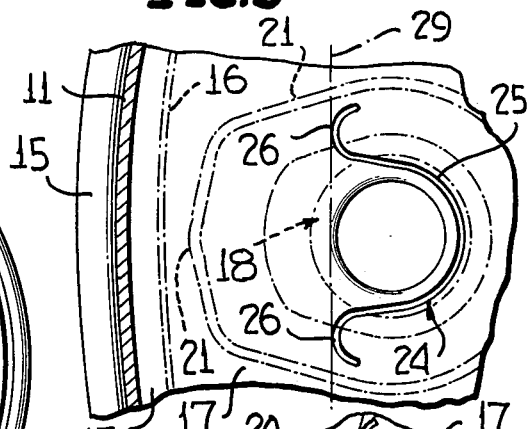
FIG.6
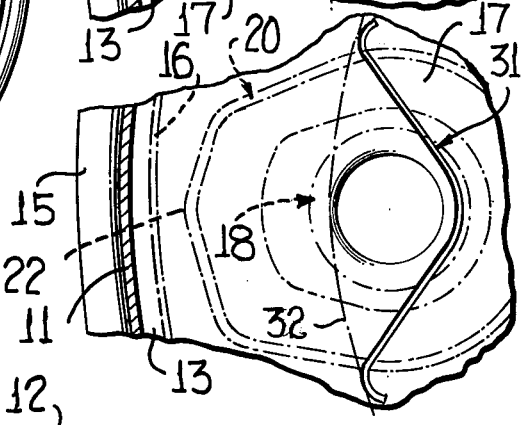
FIG.2
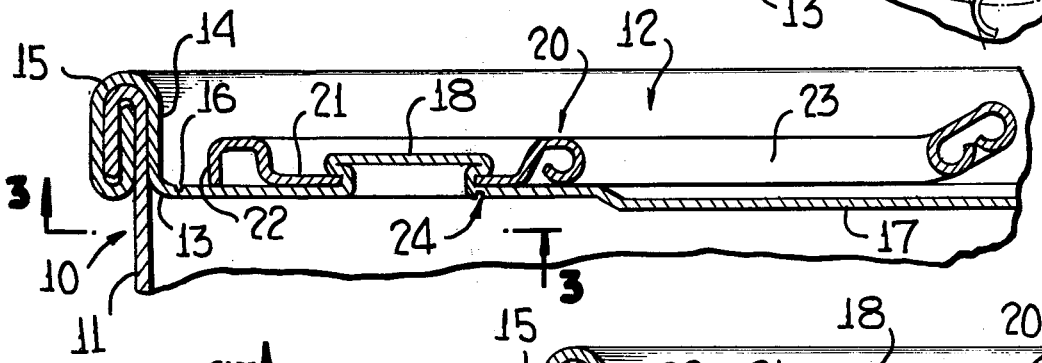
FIG.5
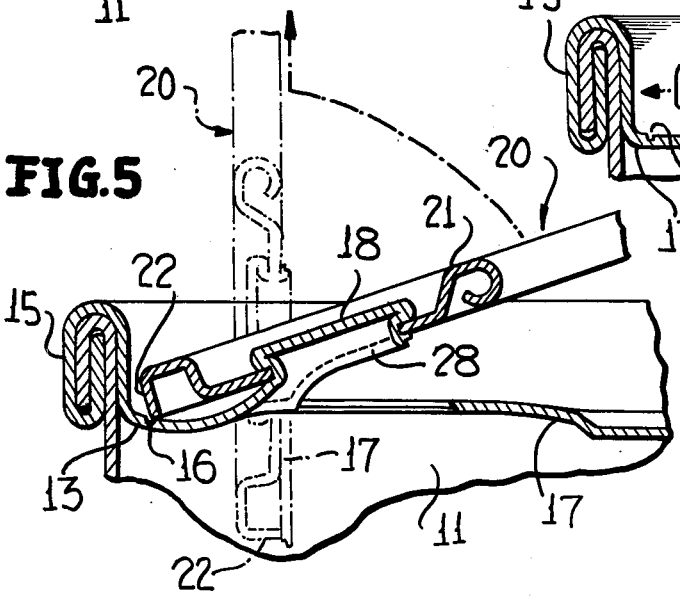
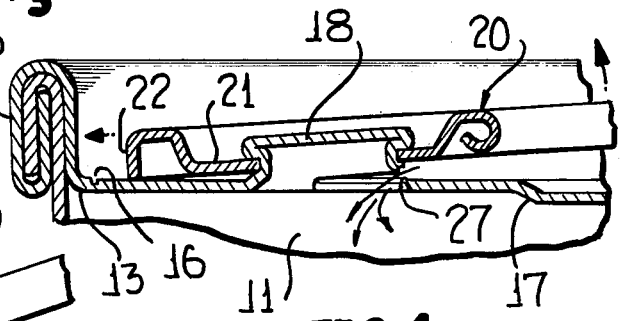
FIG.4

LEVER ACTION TAB SYSTEM FOR EASY OPENING ENDS

This invention relates in general to new and useful improvements in easy opening container ends, and more particularly to an easy opening container end having a lever action tab system.

This invention particularly relates to container ends having removable panel portions wherein an associated pull tab is attached to the removable panel portion and upon initial actuation, the container end is ruptured and a portion of the removable panel portion is depressed inwardly into the container followed by the tearing out of the removable panel portion utilizing the pull tab as a handle. In accordance with this invention, a simple weakening line is provided immediately adjacent the connection between the pull tab and the removable panel portion with the weakening line providing three beneficial functions which are highly desirable. First, the container end is so constructed whereby when the pull tab is initially lifted to effect the opening of the container end, rupture of the end panel thereof occurs along the weakening line and venting of the interior of the container is permitted. This venting is desirable whenever the interior of the container is at a pressure other than atmosphere, either positive or negative. Second, after the initial venting occurs, further upward movement of the pull tab will result in further rupture of the end panel along the weakening line with the result that that portion of the end panel which is secured to the pull tab will hinge relative to the remainder of the end panel and function as a hinge for the pull tab. This eliminates the necessity of providing a hinge on the pull tab. Third, the newly formed hinge of the end panel functions to permit the nose of the pull tab to move radially outwardly and therefore the nose of the pull tab may be initially radially inwardly offset relative to the usual score line which defines the removable panel portion. As a result, the starting portion of the score line may be conveniently placed adjacent the chuck wall of the container end while sufficient clearance is provided between the chuck wall and the nose of the pull tab for the operation of the usual seaming chuck.

With the above and other objects in view that will hereinafter appear, the nature of the invention will be more clearly understood by reference to the following detailed description, the appended claims and the several views illustrated in the accompanying drawing:

In the drawing

FIG. 1 is a plan view of a container having an easy opening end formed in accordance with this invention.

FIG. 2 is an enlarged fragmentary vertical sectional view taken along the line 2—2 of FIG. 1 and shows specifically the details of the container end and the tab system thereof.

FIG. 3 is a fragmentary horizontal sectional view taken along the line 3—3 of FIG. 2 and shows specifically the details of the weakening line formed in the end panel in accordance with this invention.

FIG. 4 is a fragmentary vertical sectional view similar to FIG. 2 and shows the initial rupture of the end panel along the weakening line of FIG. 3 upon the initial lifting of the pull tab.

FIG. 5 is another fragmentary vertical sectional view similar to FIG. 2 and shows the further action of the tab system in the opening of the container.

FIG. 6 is a fragmentary horizontal sectional view similar to FIG. 3 and shows a modified weakening line arrangement.

Referring now to the drawings in detail, it will be seen that there is illustrated a container which is formed in accordance with this invention, the container being generally referred to by the numeral 10. The container 10 may be of any type of construction, but is illustrated as including a can body 11, which may have one end (not shown) closed in any conventional manner, and the opposite end closed by means of an easy opening end, which is generally referred to by the numeral 12. The end 12, except for the easy opening features thereof is of a conventional construction and includes an end panel 13 which is generally defined by an upstanding chuck wall 14, the chuck wall 14 being a portion of a conventional double seam 15 which secures the container end 12 to the can body 11.

In the preferred embodiment of the invention, substantially the entire end panel 13 is removed in the opening of the container 10. To this end, the end panel 13 is provided with a peripheral score line 16 which is positioned as close as feasible to the chuck wall 14. At this time, it is pointed out that the removable panel configuration may be varied as required for the dispensing of the product packaged within the container 10 and the removable panel portion will not necessarily have a circular outline as is shown in FIG. 1. The configuration of the score line 16 will vary accordingly. However, the invention is particularly adapted to easy opening ends wherein starting portions of the score line are disposed closely adjacent the chuck wall 14.

In order to facilitate the rupture of the end panel 13 along the score line 16 and thereafter pull out the removable panel portion 17 defined by the score line 16, the end panel 13 is provided with an integral rivet 18 which is utilized in securing a pull tab, generally referred to by the numeral 20, to the end panel 13. The illustrated pull tab 20 is in the form of a lever and includes a rigid body 21 having at the forward end thereof a nose 22. At the opposite end of the rigid body there is a pull ring 23. The rivet 18 passes through the rigid body 21 and rigidly secures the pull tab 20 to the end panel 13.

It is to be understood that the configuration of the pull tab 20 may vary in accordance with the requirements thereof although the specific pull tab configuration illustrated in FIG. 1 is preferred.

In accordance with this invention, although it is necessary for the nose 22 to be positioned generally in alignment with the starting portion of the score line 16, the initial position of the nose 22 is radially inwardly of the score line 16, as is clearly shown in FIGS. 1 and 2. This permits sufficient clearance for a chuck (not shown) which engages the chuck wall 14 during a seaming operation required for the formation of the double seam 15. The radial inward offsetting of the nose 22 is permissible in accordance with this invention for reasons which will be defined hereinafter.

Referring now to FIGS. 2 and 3 in particular, it will be seen that the end panel 13 is provided with a further score line 24 which is preferably formed in the underside of the end panel. The score line 24 includes a central portion 25 which is preferably of a U-shaped configuration. In the preferred embodiment of the score line 24, the U-shaped central portion 25 is concentric with the rivet 18 and disposed closely adjacent thereto. However, it is to be understood that other general U-shaped configurations may be utilized for the central portion 25 of the score line 24, including a generally pointed configuration. The score line 24 also includes reversely turned end portions 26 which are continuations of the central portion 25.

OPERATION

In accordance with this invention, when it is desired to open the container 10, the ring portion 23 is engaged with one's finger and lifted upwardly in the manner generally shown in FIG. 4. This results in the initial upward stressing of the end panel 13 in the area of the score line 24 prior to the stressing of the end panel 13 in the vicinity of the score line 16 sufficient to rupture the same along the score line 16. This initial stressing of the end panel 13 results in the rupture thereof along the score line 24 and the formation of a vent opening 27 which is in the form of a narrow slit. Normally the container 10 will be packaged at a negative pressure and accordingly the venting will be in the form of air flowing inwardly into the container, as is shown in FIG. 4. On the other hand, if the pressure within the container 10 is a positive one, the flow of air or gases will be outwardly. With respect to this, it is to be noted that the body 21 of the pull tab 20 overlies the vent opening 27.

Immediately following the venting of the container 10, as the pull tab 20 is moved upwardly in the manner shown in FIG. 5, there will be a further tearing of the end panel 13 along the score line 24 with that portion of the end panel 13 from which the rivet 18 is formed swinging upwardly and defining a hinge strip 28. The line of hinging of the strip 28 will be generally along the hinge line 29 of FIG. 3, which hinge line passes to one side of the rivet 18.

As the rivet 18 moves upwardly, it will also move radially outwardly with the nose 22 of the pull tab 20 likewise moving radially outwardly to a position aligned with the score line 16.

After the nose 22 is aligned with the score line 16 along the starting portion thereof, further upward movement of the pull tab 20 from the solid line position of FIG. 4 will result in the rupture of the end panel 13 along the score line 16 starting beneath the nose 22 and spreading in circumferentially opposite directions therefrom. As a result, with the continued upward swinging of the pull tab 20, the removable portion 17 of the end panel 13 will be forced down into the interior of the container 10, as is shown in dotted lines in FIG. 5, and the removable panel portion 17 will also hinge generally along the hinge line 29.

After the pull tab 20 reaches a generally upright position, as is shown in FIG. 5, it is pulled upwardly and generally to the right with the result that there is continued rupture of the end panel 13 along the score line 16 and the entire removable panel 17 is torn out.

From the foregoing description of the opening operation with respect to the container 10, it will be seen that the score line 24 provides for the three desired functions. First, as shown in FIG. 4, the initial rupture of the end panel 13 along the score line 14 results in the formation of the vent opening 27 so as to equalize the pressure between the interior of the container 10 and the atmosphere. This prevents any possibility of either an implosion or an explosion when the end panel 13 is ruptured along the score line 16 and in this manner an uncontrolled rupture of the end panel along the score line 16 is prevented. Secondly, with further tearing of the end panel 13 along the score line 24, a hinge for the pull tab 20 is formed from the material of the end panel 13, as is shown in FIG. 5. Also, as is shown in FIG. 5, the nose 22 of the pull tab 20 moves from an out-of-the-way position spaced radially inwardly from the starting portion of the score line 16 to a position aligned with the score line 16 ready to apply a rupturing force on the end panel 13 along the starting portion of the score line 16.

Referring once again to FIG. 3, it will be apparent that the reversely turned end portions 26 of the score line 24 assure against the accidental tearing of the end panel 13 from the score line 24 to the score line 16 with the resultant tearing out of a small portion of the end panel 13 as compared to the desired larger removable panel portion 17.

It will be obvious from the drawings and the aforegoing description that the pull tab 20, when initially lifted, as is shown in FIG. 4, pivots about the nose 22 and functions as a Class 2 lever in effecting the rupture of the end panel 13 along the score line 24. In a like manner, after the initial rupture of the end panel 13 along the score line 24, as hinging of the end panel occurs generally along the hinge line 29, the pull tab 20 has a center pivot along the hinge line 29 and thereafter functions as a Class 1 lever to effect the rupture of the end panel 13 along the score line 16 in the manner shown in FIG. 5.

Although the specific configuration of score line shown in FIG. 3 is preferred, it is to be understood that a modification of the score line is permissible within limits. In FIG. 6 there is illustrated a modified form of the score line, which is generally referred to by the numeral 31. When the score line has a configuration, such as that of the score line 31, the hinge line may be arcuate, such as is the hinge line 32, with the hinge line still passing to one side of the rivet 18.

It is to be understood that the score line configuration primarily requires the score line to be positioned where an initial rupture will occur in the general manner illustrated in FIG. 4 to effect the venting of the container and the equalization of the pressure therein with that of the atmosphere, followed by the formation of the equivalent of the hinge strip 28 with the nose 22 of the pull tab moving into alignment with the score line 16.

It will be readily apparent that other score line configurations may be utilized and it is the intent of applicant to cover all score line configurations which would be formed in accordance with the spirit and scope of the invention, as defined by the appended claims.

We claim:

1. In an assembly including a panel having a removable portion, and a pull tab secured to said panel and restricted substantially against hinging relative to an adjacent portion of said panel; the improvement residing in a line of weakening formed in said panel removable portion immediately adjacent the connection between said pull tab and said panel for effecting the initial rupture of said panel upon the application of a panel rupturing force to said pull tab and the formation of hinge means in said panel with said hinge means including said connection and facilitating the hinging of said pull tab for effecting the further and separate rupture of said panel remote from said connection and the removal of said panel portion.

2. The assembly of claim 1 wherein said removable panel portion is defined by a second line of weakening formed separate and apart from the first-mentioned line of weakening.

3. The assembly of claim 1 wherein said removable panel portion is defined by a second line of weakening formed separate and apart from the first-mentioned line of weakening, and said pull tab has a force applying nose initially spaced from said second line of weakening towards said connection and being movable into alignment with said second line of weakening in response to the hinging of said hinge means relative to said panel.

4. The assembly of claim 1 wherein said line of weakening underlies said pull tab and additionally functions to form a vent opening upon the initial rupture of said panel.

5. The assembly of claim 1 wherein said line of weakening is generally U-shaped.

6. The assembly of claim 1 wherein said line of weakening is generally U-shaped and opens towards said connection.

7. The assembly of claim 1 wherein said line of weakening is generally U-shaped and has diverging end portions for preventing the accidental separate tearing out of said hinge means.

8. In a container end including an end panel defined by an upstanding chuck wall, a weakening line formed in said end panel and defining a removable panel portion, said weakening line including a starting portion disposed closely adjacent said chuck wall, a pull tab having a nose for engaging said panel along said weakening line starting portion for effecting the rupture of said panel in the removal of said panel portion, and securing means securing said pull tab to said panel; the improvement comprising the positioning of said pull tab radially inwardly of said weakening line starting line to provide clearance between said pull tab nose and said chuck wall, and said securing means including hinge means for effecting the movement of said pull tab nose into alignment with said weakening line starting portion prior to rupture therealong.

9. The container end of claim 8 wherein said hinge means are formed in said removable panel portion.

10. The container end of claim 8 wherein said hinge means includes weakening line means for automatically forming a vent opening in said removable panel portion.

11. In a container end including an end panel defined by an upstanding chuck wall, a weakening line formed in said end panel and defining a removable panel portion, said weakening line including a starting portion disposed closely adjacent said chuck wall, a pull tab having a nose for engaging said panel along said weakening line starting portion for effecting the rupture of said panel in the removal of said panel portion, and securing means securing said pull tab to said panel; the improvement comprising said securing means rigidly securing said pull tab to said panel portion and including hinge forming means in said removable panel portion for facilitating the hinging of said pull tab relative to said end panel to rupture said end panel along said weakening line starting portion.

12. The container end of claim 11 wherein said hinge forming means includes a generally U-shaped weakening line opening towards said weakening line starting portion.

13. The container end of claim 11 wherein said hinge forming means includes a generally U-shaped weakening line opening towards said weakening line starting portion and having terminal ends directed away from said weakening line starting portion for preventing the accidental tearing out of a narrow portion only of said removable panel portion between said weakening lines.

14. The container end of claim 11 wherein said line of weakening includes a generally U-shaped central portion and diverging adjacent portions.

15. The assembly of claim 1 wherein said removable panel portion is defined by a second line of weakening formed separate and apart from the first-mentioned line of weakening, and said lines of weakening define an intermediate strap-like hinge strip.

16. The assembly of claim 15 wherein said pull tab is secured only to said hinge strip.

17. In a container, the combination of:

a container wall of sheet material;

a first line of weakness in said container wall defining a tear strip manually removable therefrom;

a second line of weakness in said container wall adjacent said first line of weakness and defining a hinge, said hinge being spaced from said first line of weakness by a portion of said tear strip;

a tab lying at least partially within the area of said tear strip, said tab having a handle end and a force applying end with the force applying end lying at a preselected location closely adjacent said first line of weakness; and means integral with said tear strip for securing said tab to said tear strip, movement of said handle end of said tab urging said force applying end firmly against said container wall to cause hinged movement of said portion of said container wall about said hinge to initiate severance of the tear strip along said first line of weakness.

18. A combination as defined in claim 17 wherein said hinge lies within said tear strip and said tab extends across said hinge.

19. A combination as defined in claim 18 wherein said tear strip extends over a major portion of said container wall.

20. A combination as defined in claim 18 wherein said hinge lies intermediate said last mentioned means and said first line of weakness and said preselected location is on said tear strip.

21. In an easy-opening container wall, the combination of:

a scoreline in the container wall defining a rupture-able web in the container wall, said rupturable web defining a wall segment at least partially removable from the container wall;

a tab for initiating removal of said wall segment, said tab having a handle portion and a rupturing portion;

interconnecting means for attaching said tab intermediate said portions thereof to the container wall with the rupturing portion lying closely adjacent said rupturable web and being engageable with said wall segment whereby movement of said handle portion of said tab away from the container wall forces said rupturing portion toward the container wall; and rupturable scoreline means in the container wall adjacent said interconnecting means rupturable in response to movement of the handle portion of the tab away from the container wall to form an aperture in the container wall to facilitate continued movement of said handle portion away from the container wall whereby such continued movement of the handle portion causes said rupturing portion to initiate severance of said wall segment from the container wall along said rupturable web.

22. A tab as defined in claim 21 wherein said interconnecting means is positioned between said rupturable web and at least a portion of said rupturable scoreline means prior to said movement of said handle portion of said tab away from the container wall.

23. In an easy-opening container wall of sheet metal, the combination of:

a scoreline in the container wall defining a panel at least partially removable therefrom;

a line of weakness adjacent one end of the panel and partially enclosing a region of the panel, said line of weakness terminating short of said scoreline;

a tab having a lifting end and a rupturing end; and a hollow rivet integral with said region of the panel and partially surrounded by said line of weakness, said rivet lying intermediate said line of weakness and said scoreline, said rivet attaching said tab to the panel intermediate said ends thereof with the rupturing end of the tab closely adjacent said one end of the panel whereby movement of said handle end of said tab away from the container wall lifts said region of the panel to cause said tab to rupture said line of weakness as a rear opening tab to form an opening in the panel and causes said rupturing portion to push said one end of said panel downwardly to initiate removal of the panel from the container wall in front opening fashion.

24. A container end including an end panel, a continuous primary weakening line in said end panel defining a removable panel portion, a secondary weakening line in said removable panel portion separate and apart from said primary weakening line, a nose positioned adjacent said primary weakening line for effecting rupture of said primary weakening line, and a pull tab secured to said removable panel portion adjacent to said secondary weakening line and in alignment with said nose for first stressing said removable panel portion to effect rupture thereof along said secondary weakening line and then effecting the movement of said nose to stress said end panel along said primary weakening line to rupture said end panel therealong.

25. The container end of claim 24 wherein said pull tab is permanently connected to said nose.

26. The container end of claim 24 wherein said nose is displaced from the connection between said pull tab and said removable panel portion.

27. The container end of claim 24 wherein said nose is a part of said pull tab.

28. An end closure for a container, said end closure having a removable area defined by a score line adjacent to the periphery thereof, a rivet formed in said removable area, a pull tab secured to said removable area by said rivet and an ancillary score in said removable area, said ancillary score having a central portion adjacent to one side of said rivet, the ends of said ancillary score extending towards said peripheral score so that said pull tab may be manipulated to rupture said ancillary score and stress the metal between said scores to initiate rupture of said peripheral score.

29. The end closure defined in claim 28 wherein said central portion of said ancillary score encircles said rivet for a portion of the circumference of said rivet.

30. A container component, said component having a primary score defining a removable section in said component, an opening tab, means connecting said opening tab to said removable section and an ancillary score in said removable section adjacent said connecting means whereby when said opening tab is pulled upwardly to stress said connecting means relative to said removable section said ancillary score will rupture to permit said connecting means to move out of the plane of said removable section to facilitate the application of rupturing pressure against said primary score.

31. A container end closure, said end closure having a primary peripheral score defining a removable section, an opening tab, a rivet connecting said opening tab to said removable section, means on one side of said rivet for applying pressure to said removable section immediately inwardly of said primary score to initiate rupture of said primary score, handle means of said opening tab disposed on the opposite side of said rivet, and an ancillary score disposed closely adjacent said rivet on said opposite side thereof, said ancillary score being rupturable when said handle means is lifted to stress said rivet relative to said removable section, whereby said rivet is enabled to move out of the plane of said removable section to permit said pressure applying means to be moved by further manipulation of said handle means to effect initial rupture of said primary score.

32. A container closure having a peripheral bead for attaching the closure to the end of a container; said closure further having a flexible generally planar disc surrounded by said peripheral bead and adapted to overlie the end of the container to which it is attached, said flexible disc having a first material thickness reducing score defining a predetermined opening pattern and a second material thickness reducing score formed to lie radially inwardly of said first score to define a collar between said scores; an opening tab including a fulcrum portion terminating adjacent said first score and a handle portion; and means securing said fulcrum portion to said collar at a point adjacent said second score to cause the axis of said tab to lie radially of both scores; said score and tab arrangement responding to a lifting of the tab handle portion to fracture said second score and thereby permit said collar to twist out of the plane of said disc to permit a sharp angle of entry as the fulcrum end of said tab fractures said first score, said arrangement further permitting said first score to be fractured along its entire length in response to a pull on the handle portion of said tab directed away from said closure.

33. The structure defined in claim 32 wherein at least a portion of the first score is formed adjacent the peripheral bead of the closure.

34. The structure defined in claim 33 wherein the first score is of a circular configuration.

35. A container closure having a tear strip opener in a flat planar container wall forming portion thereof comprising in combination a primary endless score line formed in said wall portion defining a tear strip; a secondary score line formed in said tear strip and terminating in terminal end portions spaced inwardly of said primary score line so as to define a collar portion between said primary and secondary score lines; an elongated pull tab including a handle portion at one end and a fulcrum portion at the other end; and means connecting and securing said fulcrum portion of said pull tab to said collar adjacent said secondary score line so that the longitudinal axis of said pull tab extends transversely with respect to said secondary score line and the terminal end of said fulcrum portion of the pull tab is disposed adjacent a portion of said primary score line whereby lifting of the handle portion of said pull tab will effect rupture of said secondary score line, initiate rupture of said primary score line and twist the collar portion out of the plane of said wall so as to facilitate the subsequent progressive rupture of said primary score line to sever said tear strip from said wall and thereby produce an opening in said closure.

36. The structure defined in claim 35 wherein the primary score line is of a circular configuration.

37. Container easy-open structure comprising a container wall, an outer scoreline of diminished material thickness located on the container wall defining a removable portion of such wall, an inner scoreline of diminished material thickness located within the removable portion of the container wall, the scorelines defining a tear segment in the container wall located between the scorelines, an opening member, and securing means for securing the opening member to the tear segment, the opening member including a handle end in spaced relationship from the securing means, the inner scoreline having a starter section at the tear segment adjacent the securing means at a position to be ruptured with movement of the handle end of the opening member in a direction away from the container wall, the outer scoreline having a starter section at the tear segment adjacent the securing means at a position to be ruptured with movement of the handle end of the opening member in a direction away from the container wall, the rupture of one of the starter sections being by Class 1 lever action and the rupture of the other starter section being by Class 2 lever action, the starter sections of the scorelines being located on opposite sides of the securing means so that the securing means is completely within the tear segment.

38. The structure of claim 37 in which the opening member includes an end portion adjacent the securing means, the end portion of the opening member adjacent the securing means including means for rupturing the starter section of the outer scoreline by Class 1 lever action.

39. The structure of claim 38 in which the starter section of the inner scoreline includes a pointed configuration with the starter section of the inner scoreline beinc ruptured by Class 2 lever action.

40. The structure of claim 37 in which the tear segment extends between the scorelines around a peripheral segment of the removable portion of the wall.

41. The structure of claim 37 in which the starter section of the inner scoreline adjacent the securing means includes a pointed configuration.

42. The structure of claim 41 in which the pointed configuration of the inner scoreline starter section projects in a direction away from the securing means.

43. The structure of claim 37 in which the tear segment has opposite ends and a midsection, and the opening member is secured to the midsection of the tear strip.

44. Container easy-open structure comprising a container wall, an outer scoreline of diminished material thickness defining a removable portion of the container wall, an inner scoreline of diminished material thickness located within the removable portion of the container wall, the scorelines defining a tear segment extending between the scorelines around a peripheral segment of the removable portion of the wall, an opening member, and securing means for securing the opening member to the tear segment, the opening member having a handle end and a remaining end located on opposite sides of the securing means, the inner scoreline having a starter section located in close proximity to the securing means at a position to be ruptured by Class 2 lever action with movement of the handle end of the opening member in a direction away from the wall, the outer scoreline having a starter section, the starter sections of the inner and outer scorelines being located on opposite sides of the securing means, the remaining end of the opening member including rupturing means for rupturing by Class 1 lever action the starter section of the outer scoreline with movement of the handle end of the opening member in a direction away from the wall.

45. The structure of claim 44 in which the tear segment has opposite ends and a midsection and the opening member is secured to the midsection of the tear segment.

46. The structure of claim 44 in which the rupturing means at the remaining end of the opening member is aligned with and contiguous the starter section of the outer scoreline.

47. The structure of claim 44 in which at least a major portion of the starter section of the inner scoreline underlies the opening member, with the starter section of the inner scoreline being positioned to be ruptured upon movement of the handle end of the opening member away from the container wall and the starter section of the outer scoreline being positioned to be ruptured subsequent to rupture of the inner scoreline.

48. The structure of claim 47 in which the starter sections of the scorelines are positioned to be ruptured in rapid sequence.

49. The structure of claim 47 in which the starter section of the inner scoreline includes a pointed configuration underlying the opening member and projecting in a direction away from the securing means.

50. The structure of claim 44 in which the removable portion of the container wall constitutes a major portion of a wall of the container.

51. The structure of claim 50 in which the container wall is an end wall.

52. The structure of claim 44 in which movement of the rupturing means is in a direction toward the container wall with movement of the handle end of the opening member in a direction away from the wall.

53. The structure of claim 44 in which the securing means comprises a unitary rivet, the rivet being formed from material of the container wall.

54. The structure of claim 44 in which the container wall comprises sheet metal.

* * * * *

REEXAMINATION CERTIFICATE (24th)

United States Patent [19]

Holk, Jr. et al.

[11] B1 4,182,460

[45] Certificate Issued Oct. 19, 1982

[54] LEVER ACTION TAB SYSTEM FOR EASY OPENING ENDS

[75] Inventors: Albert J. Holk, Jr., Frankfort; Arnold R. Boik, Chicago, both of Ill.

[73] Assignee: The Continental Group, Inc., New York, N.Y.

Reexamination Request

No. 90/000,076, Sep. 28, 1981

Reexamination Certificate for:

| | |
|---|---|
| Patent No.: | **4,182,460** |
| Issued: | **Jan. 8, 1980** |
| Appl. No.: | **656,388** |
| Filed: | **Jul. 27, 1967** |

[51] Int. Cl [3] ..... B65D 41/32

[52] U.S. Cl ..... 220/271; 220/273

[58] Field of Search ..... 220/265–273

[56] References Cited

U.S. PATENT DOCUMENTS

| | | |
|---|---|---|
| 2,772,808 | 12/1956 | Fried. |
| 3,089,609 | 5/1963 | D'Andrea. |
| 3,416,699 | 12/1968 | Bozek. |

*Primary Examiner*—George T. Hall

[57] ABSTRACT

This disclosure has to do with an easy opening container end wherein substantially the entire end panel is removed. The removable panel portion has rigidly attached thereto a pull tab which is first utilized as a lever to obtain the initial rupture of the end panel and then as a handle to tear out the removable panel portion. The removable panel portion is provided with a weakening line immediately adjacent the connection between the pull tab and the removable panel portion for the purpose of first venting the interior of a container and then forming a hinge which will permit the necessary pivoting of the pull tab relative to the end panel.

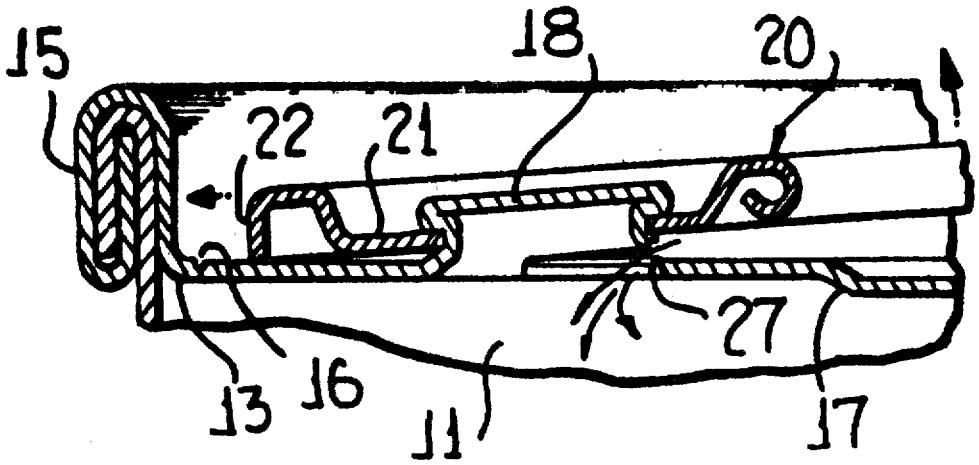

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-10, 16, 18, 19 and 21-54 is confirmed.

Claims 11-15, 17 and 20 are determined to be patentable as amended:

11. In a container end including an end panel defined by an upstanding chuck wall, a [weakening] *score* line formed in said end panel and defining a removable panel portion, said [weakening] *score* line including a starting portion disposed closely adjacent said chuck wall, a pull tab having a nose for engaging said panel along said [weakening] *score* line starting portion for effecting the ruputre of said panel in the removal of said panel portion, and securing means securing said pull tab to said panel; the improvement comprising said securing means rigidly securing said pull tab to said panel portion and including hinge forming means in said removable panel portion for facilitating the hinging of said pull tab relative to said end panel to rupture said end panel along said [weakening] *score* line starting portion.

12. The container end of claim 11 wherein said hinge forming means includes a generally U-shaped [weakening] *score* line opening towards said [weakening] *score* line starting portion.

13. The container end of claim 11 wherein said hinge forming means includes a generally U-shaped [weakening] *score* line opening towards said [weakening] *score* line starting portion and having terminal ends directed away from said [weakening] *score* line starting portion for preventing the accidental tearing out of a narrow portion only of said removable panel portion between said [weakening] *score* lines.

14. The container end of claim 11 wherein said *score* line [of weakening] includes a generally U-shaped central portion and diverging adjacent portions.

15. The assembly of claim 1 wherein said removable panel portion is defined by a second *score* line [of weakening] formed separate and apart from the first-mentioned *score* line [of weakening], and said *score* lines [of weakening] define an intermediate strap-like hinge strip.

17. In a container, the combination of:

a container wall of sheet material;

a first *score* line [of weakness] in said container wall defining a tear strip manually removable therefrom;

a second *score* line [of weakness] in said container wall adjacent said first *score* line [of weakness] and defining a hinge, said hinge being spaced from said first *score* line [of weakness] by a portion of said tear strip;

a *separate* tab lying at least partialy within the area of said tear strip, said tab having a handle end and a force applying end with the force applying end lying at a preselected location closely adjacent said first *score* line [of weakness]; and means integral with said tear strip for securing said tab to said tear strip, movement of said handle end of said tab urging said force applying end firmly against said container wall to cause hinged movement of said portion of said container wall about said hinge to initiate severance of the tear strip along said first *score* line [of weakness].

20. A combination as defined in claim 18 wherein said hinge lies intermediate said last mentioned means and said first *score* line [of weakness] and said preselected location is on said tear strip.

* * * * *